US008690047B2

(12) United States Patent
McKenna et al.

(10) Patent No.: US 8,690,047 B2
(45) Date of Patent: Apr. 8, 2014

(54) CONTAINER WITH INCLINED WALLS, STACKING TABS AND REINFORCED CORNERS

(75) Inventors: David J. McKenna, Clovis, CA (US); David J. Kent, La Mirada, CA (US); Herbert D Muise, Jr., Mira Loma, CA (US); Stanley Lee Fry, West Covina, CA (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 13/428,469

(22) Filed: Mar. 23, 2012

(65) Prior Publication Data

US 2014/0061289 A1 Mar. 6, 2014

(51) Int. Cl.
*B65D 5/28* (2006.01)
*B65D 21/032* (2006.01)

(52) U.S. Cl.
USPC ..... 229/143; 229/191; 229/918; 229/919

(58) Field of Classification Search
USPC ..... 229/143, 191, 915, 918, 919
See application file for complete search history.

(56) References Cited

U.S. PATENT DOCUMENTS

| | | | | |
|---|---|---|---|---|
| 5,002,224 | A * | 3/1991 | Muise | 229/918 |
| 5,452,848 | A | 9/1995 | Mur Gimeno | |
| 5,673,848 | A * | 10/1997 | Garza | 229/191 |
| 5,860,590 | A * | 1/1999 | Blomfield et al. | 229/918 |
| 6,899,266 | B2 * | 5/2005 | Conway | 229/918 |
| 7,487,905 | B2 * | 2/2009 | McClure | 229/143 |
| 7,665,654 | B2 * | 2/2010 | McLeod | 229/143 |
| 2004/0041015 | A1 * | 3/2004 | Fry | 229/915 |
| 2004/0256448 | A1 * | 12/2004 | Blomfield et al. | 229/915 |
| 2005/0145687 | A1 * | 7/2005 | Conway | 229/919 |
| 2007/0051789 | A1 * | 3/2007 | Panduro et al. | 229/918 |
| 2010/0219232 | A1 | 9/2010 | Smith | |

FOREIGN PATENT DOCUMENTS

| | | |
|---|---|---|
| FR | 2829994 | 3/2003 |
| WO | 9322206 | 11/1993 |

* cited by examiner

*Primary Examiner* — Gary Elkins
(74) *Attorney, Agent, or Firm* — Matthew M. Eslam; Dennis H. Lambert; Thomas W. Ryan

(57) ABSTRACT

A one-piece container formed from a single unitary blank of corrugated paperboard has a bottom wall, opposed side walls and inwardly inclined opposed end walls. Stacking tabs project upwardly from the end walls and tab locks in the bottom wall receive the stacking tabs of a subjacent container when the containers are stacked on top of one another. A reinforcing corner post extends the full height of the container in each corner. The corner posts are formed by panels extending from opposite ends of the end walls, wherein the panels include a first panel foldably joined to an end of an associated end wall and adhered to an adjacent side wall, a second panel foldably joined to the first panel and extending diagonally across the corner, and a third panel foldably joined to the second panel and adhered to an adjacent side wall.

2 Claims, 8 Drawing Sheets

CONTAINER WITH INCLINED WALLS, STACKING TABS AND REINFORCED CORNERS

TECHNICAL FIELD OF THE INVENTION

The present invention relates to a container for storing and transporting products such as agricultural produce. In particular, the present invention relates to a paperboard container made from a single unitary blank that has the same if not greater stacking strength than current multi-piece designs, has the same outside dimensions as current designs and is able to fit within existing warehouse and storage racking systems, and is able to withstand up to three months in cold storage.

BACKGROUND ART

Containers made of corrugated paperboard are commonly used for storing and shipping agricultural produce. Typically, such containers are formed from a blank scored with score lines and cut lines and have a bottom and opposed sidewalls. As used herein, the term "sidewalls" refers to the side walls extending along opposite sides of a container and the end walls extending across opposite ends of a container. The term "side wall" or "end wall" is used when a particular wall is intended. The blanks are most often formed by automated machines in a continuous in-line process involving cutting, scoring and molding continuous sheets of paperboard. The paperboard is then folded along the score lines and cut lines to form a container. The blanks may be folded into a container by an automated machine or may be set up by hand.

Conventional containers used within many produce segments typically comprise three-piece Bliss style cartons. These container designs have to be run over two different machines at the box plants, requiring extra manpower to run the machines, and they require extra warehousing for the three pieces and extra labor for set-up at the customer's locations.

During use, containers are often stacked on top of one another for ease of shipping and for optimum use of space. For stability in stacking the containers it is common to have stacking tabs extending upward from the top edge of the container sidewalls. These stacking tabs often fit into corresponding notches cut into a superjacent container to help secure the stack. Since containers are usually stacked on top of like-sized containers, the stacking tabs that extend upwardly from a lower container are positioned directly into the sidewalls of a superjacent container. Thus, to accommodate the stacking tabs on a lower container, a complementary notch must be cut out of the bottom edge of the sidewall of a higher container. However, a notch in a sidewall is problematic in that it does not secure the stacking tab on all four sides. Thus, these sidewall notches do not fully prevent side-to-side movement, subjecting the stack to potential toppling. This is sometimes circumvented by having a multi-ply or multi-layer sidewall, wherein a stacking tab extends upwards from an inner layer of the sidewall, thereby aligning the stacking tabs with the bottom panel of an adjacent container as opposed to the sidewall. This, however, requires excess paperboard to be used to create the multi-layer sidewall, and results in related increased costs.

Further, it is easy to misalign a container during stacking such that a higher container falls into a lower container, usually on an angle, potentially damaging the contents of the lower container. To solve this, several prior art containers have been designed with inwardly inclined sidewalls, wherein the distance between the opposing top edges of the sidewalls is less than the distance between the opposing lower edges of the sidewalls. This eases stacking by severely limiting the probability of the higher container falling into a lower container, since the narrower upper portion creates a more functional ledge for the base of the higher container to rest on.

Some prior art containers have reinforcing corner posts to increase their stacking strength and to assist in preventing an upper container from falling into a lower container when they are stacked, but applicant is not aware of any prior art container that has both full depth reinforcing corner posts and inclined side walls with stacking tabs. One prior art container with inclined side walls has diagonally extending reinforcing corner panels at the upper margin of the container, but these panels do not extend the full height of the container.

Other prior art containers have full depth reinforcing corner posts to increase stacking strength, but they do not have inclined sidewalls.

Applicant is not aware of any prior art paperboard container that has inclined sidewalls, stacking tabs, and full height reinforcing corner posts, and especially such a structure wherein panels extending from opposite ends of the sidewalls are folded to form the corner posts and include sections adhered to adjacent portions of the side walls and end walls.

SUMMARY OF THE INVENTION

The invention comprises a one-piece container made from a single unitary blank of corrugated paperboard. The container has inwardly inclined side walls or end walls, double thickness stacking tabs with vertical corrugations, and full height reinforcing corner posts, wherein panels extending from opposite ends of the side walls or end walls are folded to form the corner posts and include sections adhered to adjacent portions of the side walls and end walls to hold or aid in holding the side walls and end walls in erected position. The stacking tabs extend in coplanar relationship with the associated inclined wall, and in a preferred construction tab locks are scored and cut in the bottom wall of the container for accepting and securing the stacking tabs of a subjacent container.

The one-piece container of the invention is made from a single unitary blank and is a replacement for the three-piece Bliss style carton currently used within many produce segments. The container has the same if not greater stacking strength than current multi-piece designs, has the same outside dimensions as current designs and is able to fit within existing warehouse and storage racking systems, and is able to withstand up to three months in cold storage. The inclined side walls or end walls of the container and the correspondingly inclined stacking tabs ensure that the stacking tabs fit into the tab locks in the bottom wall panel of a superjacent container and not into the side or end walls of the superjacent container. The tab locks capture the tabs on all four sides, resulting in a secure stack without requiring excess paperboard material. The combination of these features results in containers that are easy to stack and container stacks that are not prone to toppling, without using excess paperboard.

In a preferred construction the tab locks comprise a cut-out slot coupled with a flap, wherein the flap can bend upwards, thereby better accommodating an inclined stacking tab. Further, as stacking of adjacent containers is only possible if the pattern of the cut-out slots is configured in the same pattern as the stacking tabs, the locks are positioned to engage and lock the stacking tabs in a specific configuration. Therefore, the locks of the present invention can be scored and cut in any arrangement to fit on various arrangements of stacking tabs.

For example, the bottom wall panel may contain four locks in a particular arrangement to accommodate four stacking tabs of a particular arrangement. Similarly, the locks may be inwardly spaced at different distances from an outer edge of the bottom wall panel to accept stacking tabs that are inclined at various angles.

The container of the invention incorporates internal corner posts and an internal minor flap that keep an upper container from nesting into a lower container. The container can be devoid of top flaps or lid panels, or it can have full or partial lid panels. In those embodiments incorporating lid panels, locking tabs on the lid panels engage and lock over the stacking tabs. The tab locks that trap the stacking tabs lock stacked containers to one another. The stacking tabs are of double thickness with vertical corrugations. The style and size of the corner posts can be adjusted for different tray packs but still allow the tray to run on current equipment.

The container can be made with or without top flaps and the corner posts can be adjusted to fit different product lines. The one-piece design allows the customer to handle less inventory as compared with current styles. The corner posts provide increased stacking strength and prevent containers from nesting into each other when they are stacked. The inclined side walls or end walls provide improved stacking and lock the containers to one another by trapping the stacking tabs in the tab locks of a superjacent container. The locking feature on the top flaps or lid panels prevents the top flaps from opening during shipping and handling. This locking feature also permits the opening and relocking of the flaps for product inspection.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE PREFERRED EMBODIMENTS

Figure 1:
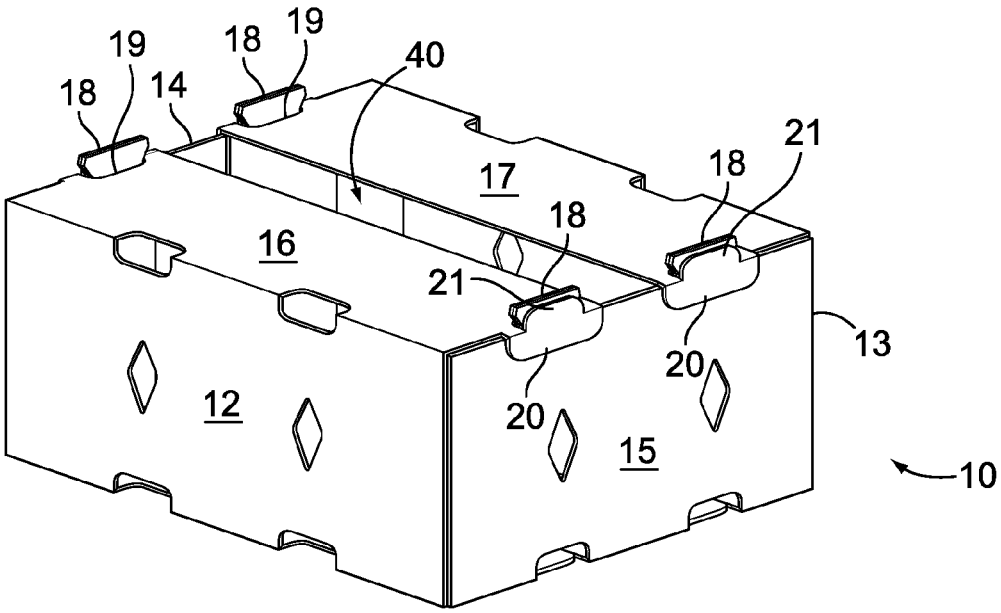
FIG. 1 is a top isometric view of a container in accordance with the invention.

A first, preferred form of container 10 according to the invention and a blank B1 for making it are shown in FIGS. 1-13. The container has a bottom wall 11, opposite side walls 12 and 13, opposite end walls 14 and 15, and partial lid panels 16 and 17 folded inwardly from opposite sides of the container. Stacking tabs 18 on the upper edges of the end walls are received in slots 19 in the lid panels, and locking tabs 20 on the lid panels are folded downwardly over the outside of the stacking tabs and against the upper outer edge of the respective end wall to lock the lid panels in closed position. Upwardly extending heels 21 on the locking tabs lie against the outside of the respective stacking tabs to hold the locking tabs in their downwardly folded locked position as shown in FIG. 1. The locking tabs 20 and heels 21 are formed by shaped cuts 22 made in opposite ends of the lid panels, and the slots 19 result when the locking tabs and associated heels 21 are folded out of the plane of the respective lid panel.

Figure 2:
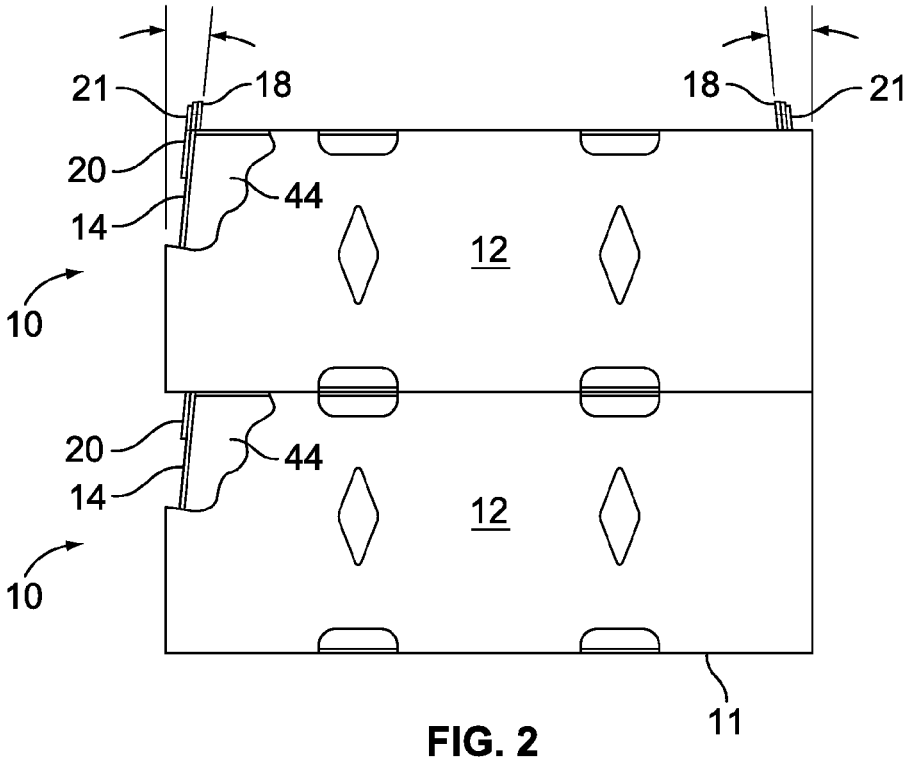
FIG. 2 is a side view in elevation of two containers according to the invention stacked on top of one another and showing the inwardly inclined end walls.
Figure 3:
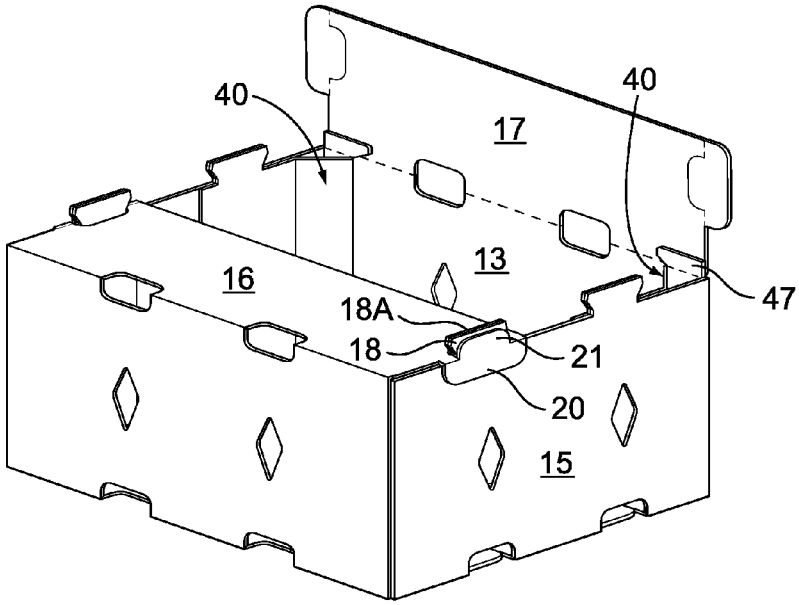
FIG. 3 is a top isometric view of the container of FIG. 1 with one of the lid panels open.

As seen best in FIG. 2, the end walls 14 and 15 are inwardly inclined, and the stacking tabs 18 on the upper edges of the end walls are coplanar with the end walls so that they are correspondingly inwardly inclined. Further, as seen best in FIG. 6, opposite side edges of the stacking tabs are slightly undercut, defining shoulders 23 that aid in retaining the locking tabs in locked position over the stacking tabs.

Figure 6:
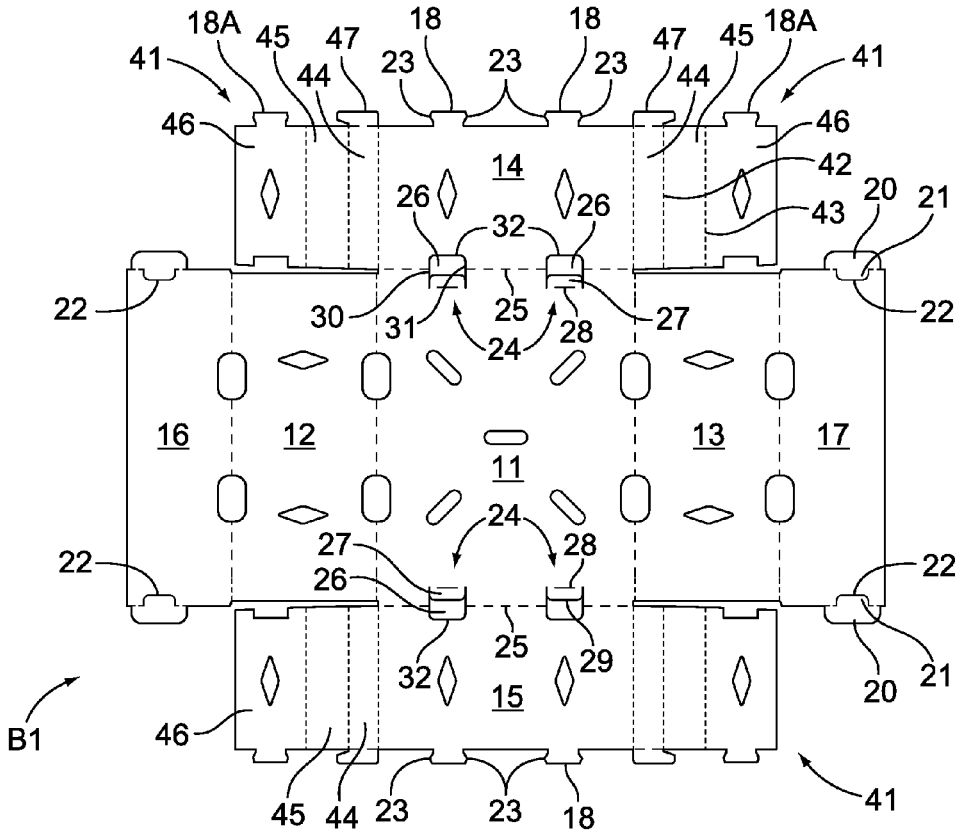
FIG. 6 is a plan view of a blank for making the container of FIG. 1.

Tab locks 24 of the type disclosed in applicant's U.S. Pat. No. 7,677,454 are cut and scored in the bottom wall 11 adjacent its folded connection 25 with an associated end wall, as shown in FIG. 6, or inwardly spaced from fold line 25 a predetermined distance (not shown), depending upon the desired or necessary configuration. Each lock 24 comprises a cut-out slot 26 coupled with a bendable flap 27, wherein the slot is designed to engage and secure a stacking tab 18 of a subjacent container. To fully engage and accept a stacking tab that enters through cut slot 26 on an angle, flap 27 has the ability to bend upwards along a back cut line 28. Flap 27 has a length, width and thickness, wherein the thickness is equal to the thickness of the bottom wall 11, and the length and width can vary within the scope of the invention as long as the flap sufficiently engages a stacking tab to frictionally hold it in the slot 26. The flap is bordered by contact edge 29, back cut line 28, and side cut lines 30 and 31. Contact edge 29 is the part of the flap that engages and holds secure stacking tabs 18 by rubbing against the tabs and holding them secure with a frictional force. Back cut line 28 is preferably a small cut line upon which flap 27 can pivot, and extends parallel to contact edge 29 and perpendicular to side cuts 30 and 31. However, the back cut line does not run the full length of contact edge 29, but is located intermediate and spaced from the side cuts 30 and 31. In alternate embodiments (not shown), the back cut line is a perforated cut line that runs between side cuts 30 and 31. Cut lines 30 and 31 are incisions that extend laterally from the back of flap 27 to the fold line 25, parallel to each other and downwardly though the entire thickness of the bottom wall 11. The cut lines enable the flap to extend upward about the back cut line without encountering undue resistance from the part of bottom wall panel 11 that borders flap 27. Contact edge 29 extends from cut line 30 to cut line 31 parallel to fold line 25, and engages tab 18 when it is inserted through slot 26, holding the tab securely in place. In the embodiment shown, the contact edge extends in a slight, tongue-shaped outward arc. However, the shape of the contact edge may be altered in other embodiments.

Cut-out slot 26 extends across fold line 25 from contact edge 29 of flap 27 to an edge 32 in the adjacent end wall panel, and is further bordered by side cuts 30 and 31. The width of the slot is great enough so that stacking tabs 18 can extend through the slot between the side cuts. However, the length between contact edge 29 and edge 32 may be less than the thickness of the stacking tabs, enabling the tabs to press against a portion of flap 27, causing the flap to bend upwards to accommodate the tab.

Each slot 26 is aligned to accept a stacking tab on a slight taper. If the degree of taper changes, the alignment can change accordingly. For example, if end walls 14 and 15 are inclined at a greater angle than shown in FIG. 2, the stacking tabs 18 will contact the bottom wall panel 11 of the superjacent container at some point closer to the center of bottom wall panel 11. To account for this, the slots can be inwardly spaced from fold line 25, thereby being aligned to accept the tabs.

Reinforcing corner posts 40 extend diagonally across each interior corner of the container. The corner posts extend the full height of the container and are formed by folded corner post panels on opposite side edges of each end wall. The construction of the corner posts is seen best with reference to FIGS. 3-11.

Referring first to FIG. 6, corner post panels 41 are foldably joined to each end of each end wall panel 14, 15. Each flap is divided by spaced apart parallel folds 42 and 43 into first, second and third rectangular panels 44, 45 and 46, respectively. The first panels 44, positioned contiguous to the associated end wall 14 or 15, are folded perpendicular to the end wall and adhered to an adjacent inner end surface of an adjacent side wall 12 or 13. The second panels 45 are folded at an acute angle to the first panels so that they extend diagonally across an interior corner of the container, and the third panels 46 lie against and are adhered to the inner surface of the adjacent end wall. It will be noted that the blank preferably is cut so that the corrugations in the end walls, corner posts and stacking tabs extend vertically. A stacking tab 18A is on the upper edge of panel 46 and is adapted to lie against stacking tab 18 on end wall 14 or 15 when the container is erected.

Figure 4:
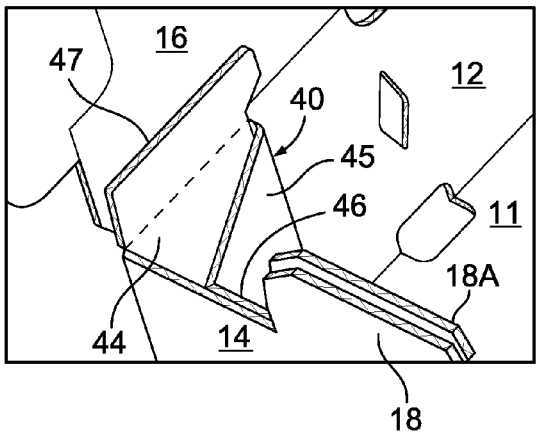
FIG. 4 is a greatly enlarged fragmentary top isometric view of one corner of the container of the invention, showing the corner post pad in position to be folded over the top of the corner post in a preferred construction of the invention.
Figure 5:
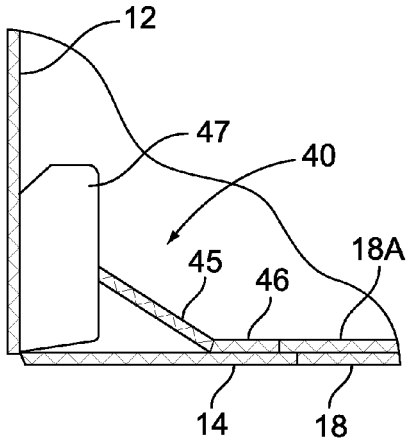
FIG. 5 is a greatly enlarged fragmentary plan view of one corner of the container, showing the corner post pad folded on top of the corner post.

Small corner post pads 47 are foldably joined to the upper edge of the first panels 44, and these pads are folded over the upper ends of the corner posts as seen best in FIGS. 4 and 5.

Figure 7:
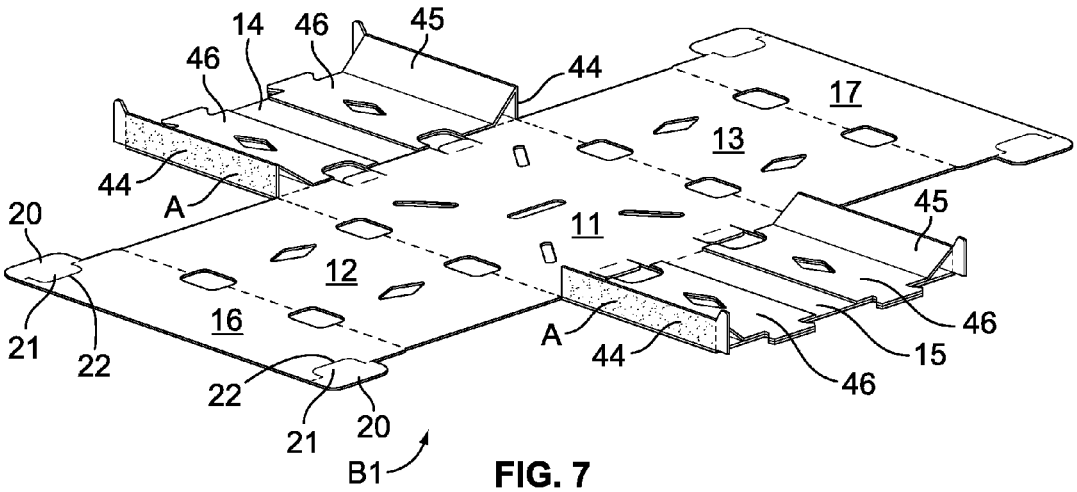
FIG. 7 is an isometric view of the blank of FIG. 1 in a first, initial folded state.
Figure 8:
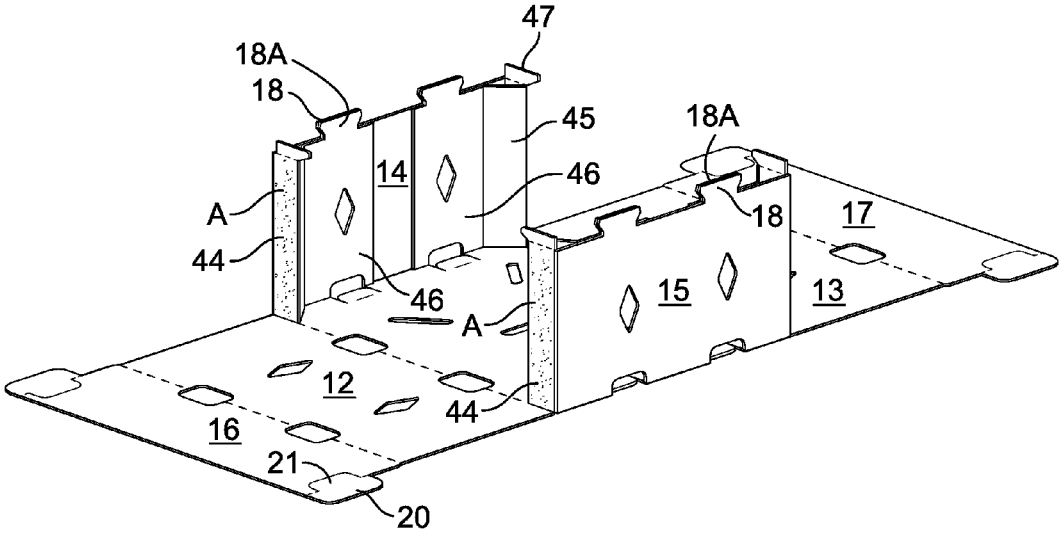
FIG. 8 is an isometric view of the blank in a second folded state.
Figure 9:
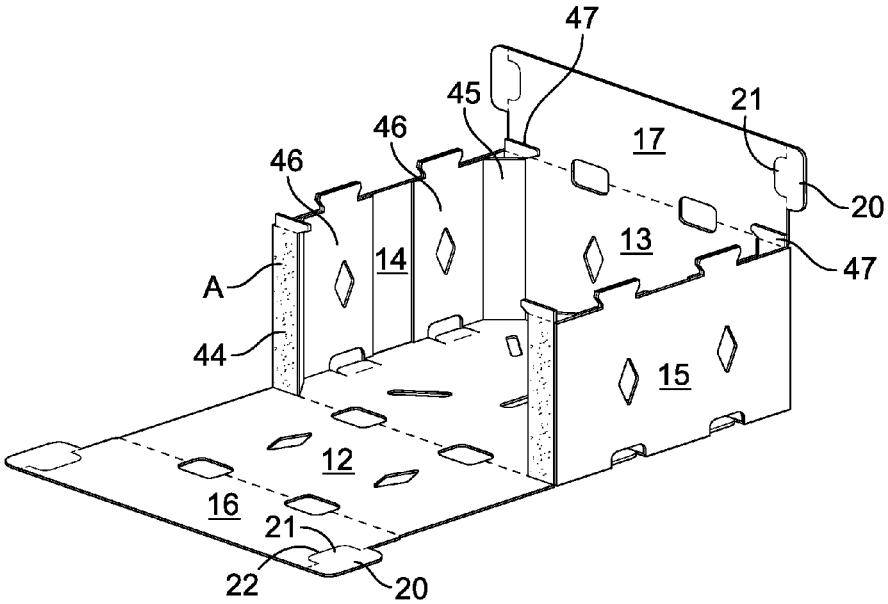
FIG. 9 is an isometric view of the blank in a third folded state.
Figure 10:
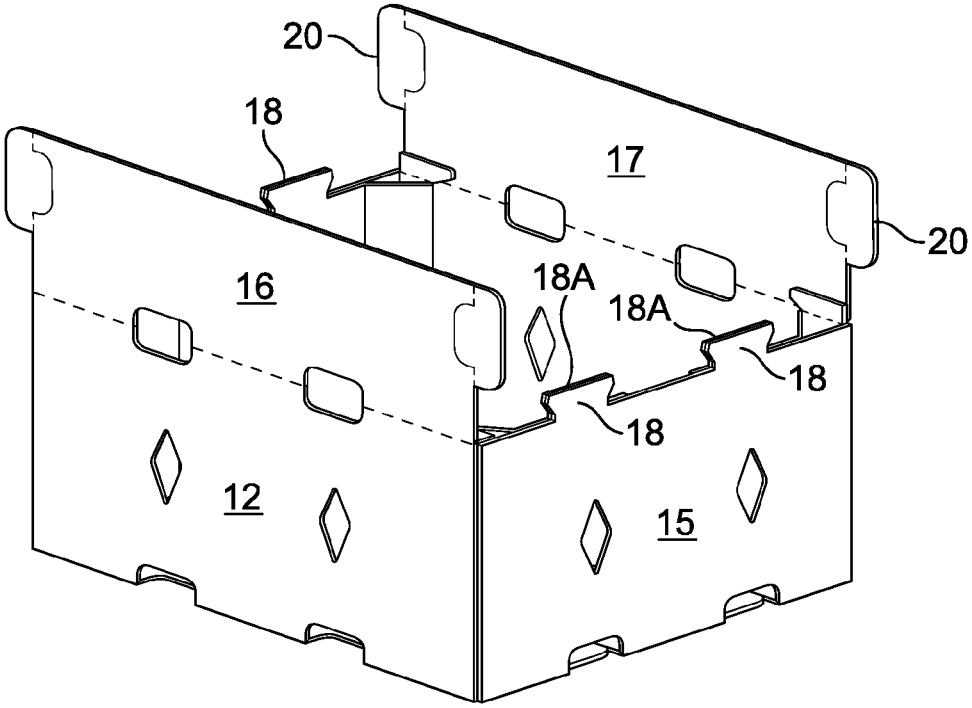
FIG. 10 is an isometric view of the blank in a fourth folded state, erected and ready to accept product before the lid panels are folded into closed position.
Figure 11:
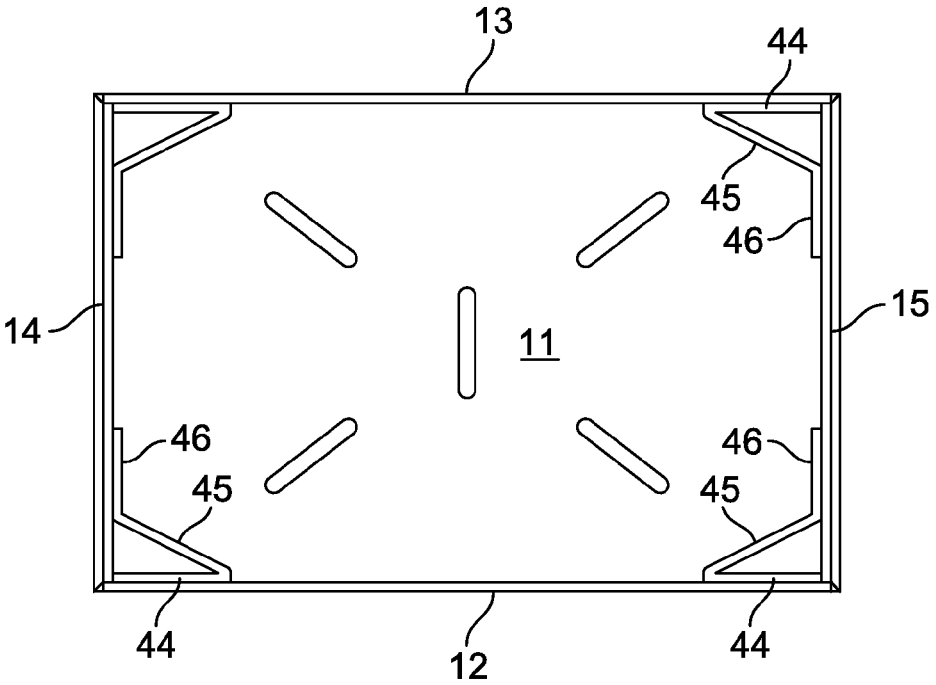
FIG. 11 is a top plan view of the container of FIG. 10, with the lid panels and corner post pads omitted for simplicity of illustration.
Figure 12:
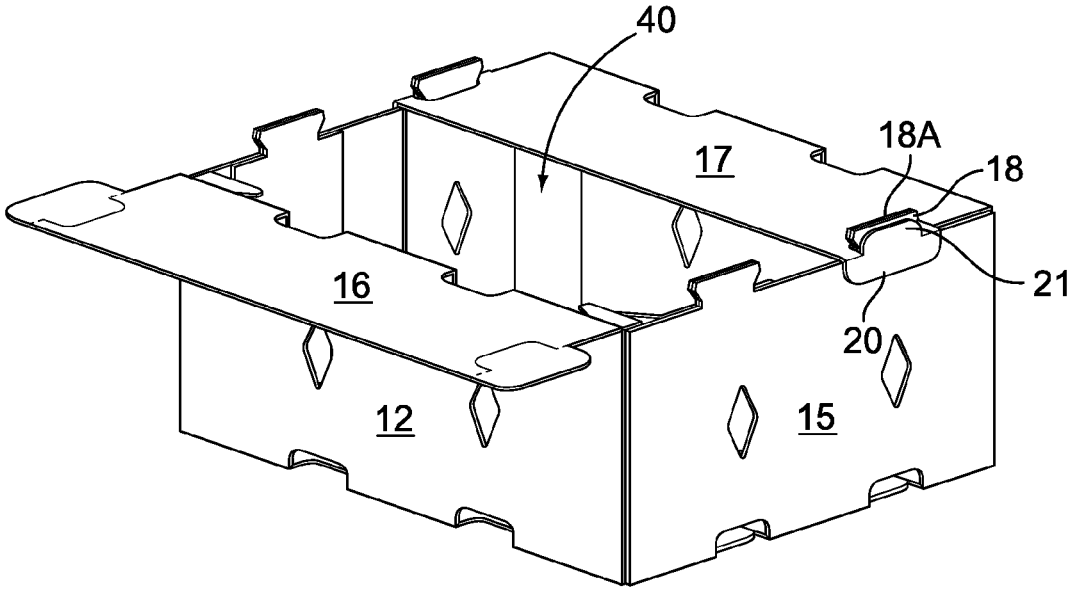
FIG. 12 is an isometric view of the container with one lid panel folded and locked in operative closed position.
Figure 13:
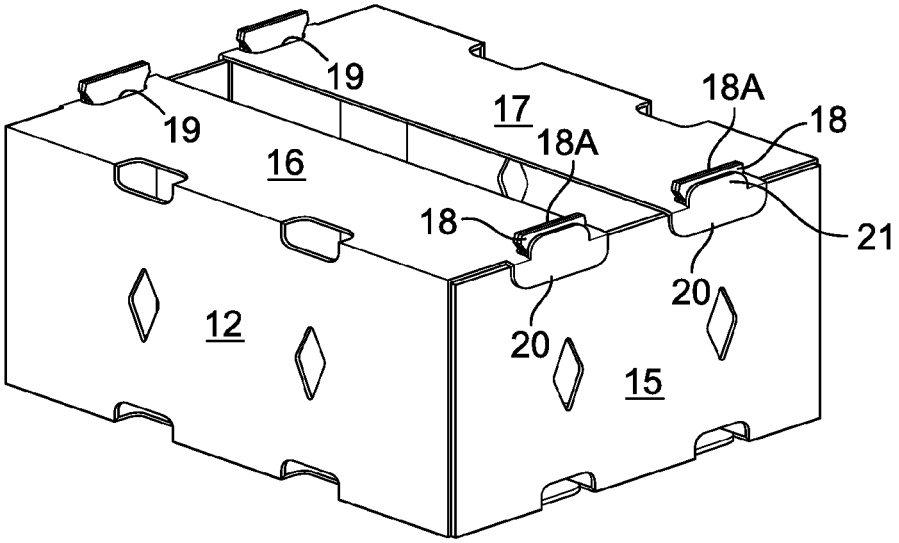
FIG. 13 is an isometric view of the container fully erected with both lid panels folded and locked in operative closed position.

The sequence of folding the blank B1 to form the erected container of FIG. 1 is depicted in FIGS. 7 through 13. Thus, as seen in FIG. 7, the panels 44-46 are folded so that the first panels 44 extend perpendicular to the associated end wall panel 14 or 15 and the second panels 45 extend diagonally, with third panels 46 lying against and adhered to the associated end wall panel. The end wall panels are then folded up as shown in FIG. 8 so that they extend perpendicular to the bottom wall panel 11, followed by folding the side wall panels 12 and 13 so that they extend perpendicular to the bottom wall panel, with the interior end surfaces of the side wall panels lying against and adhered to the first panels 44. The container is then ready to be loaded with product and the lid panels closed and locked as described previously herein. When the lid panels are folded to their closed positions, the corner post pads 47 fold down and lie between the lid panels and upper ends of the corner posts.

Figure 14:
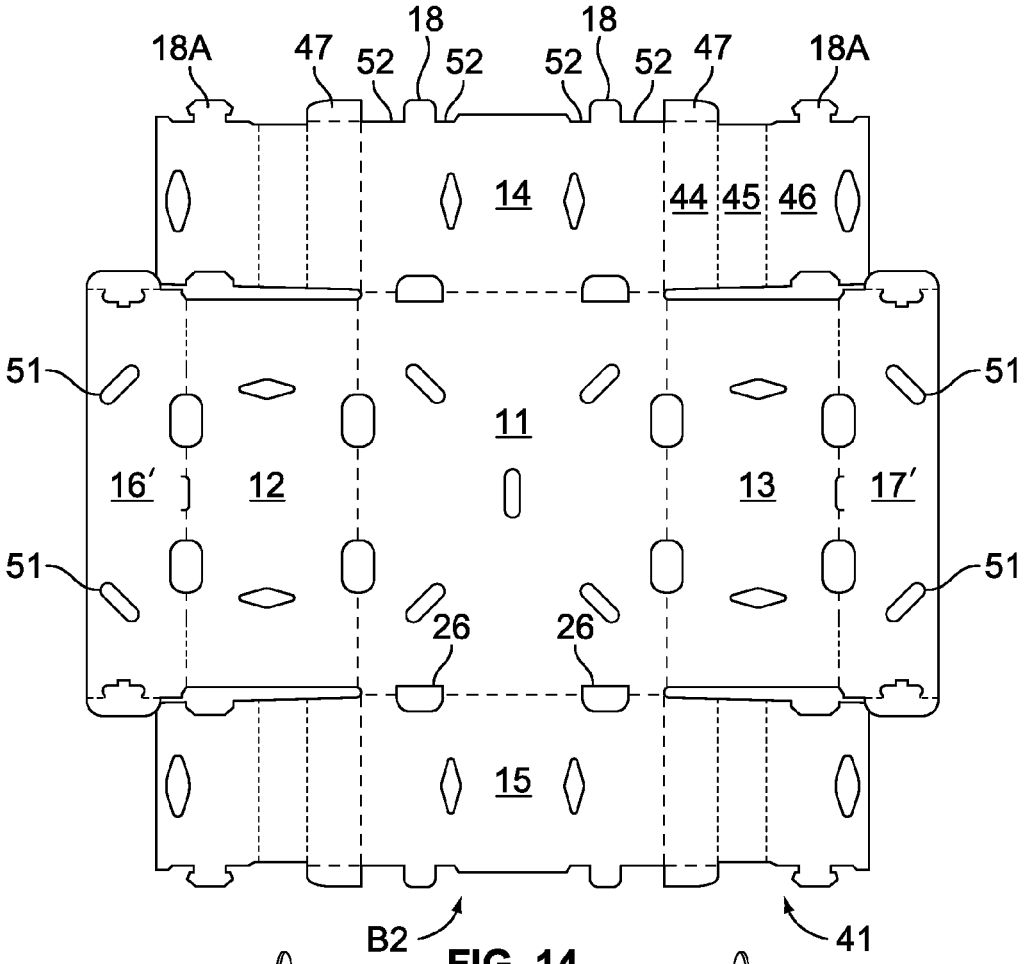
FIG. 14 is a top plan view of a blank for making a second embodiment of container according to the invention, wherein vent openings are provided in the lid panels.
Figure 15:
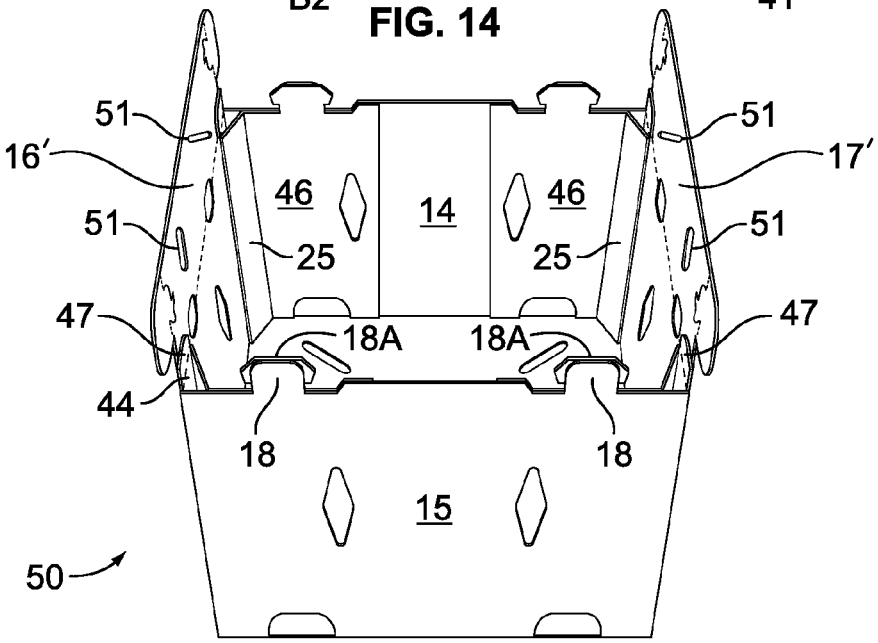
FIG. 15 is a top isometric view of a container made from the blank of FIG. 14, shown with the lid panels in open position.

A second embodiment of container 50 and blank B2 for making the container are shown in FIGS. 14 and 15. This form of the invention is essentially identical to the first form described, except that vent openings 51 are provided in the lid panels 16', 17', the bendable flaps 27 are omitted from the cut-outs 26, and slight depressions 52 are formed in the upper edges of the end walls 14 and 15 at opposite side edges of the stacking tabs 18.

Figure 16:
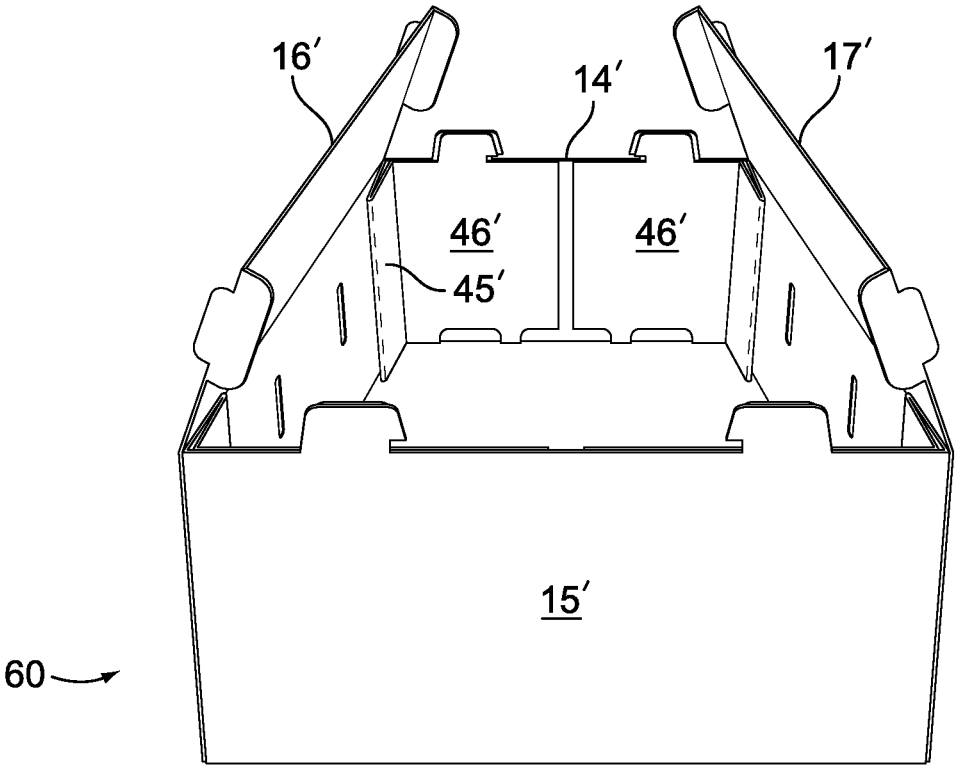
FIG. 16 is a top isometric view of a third embodiment of container according to the invention, wherein the end walls and lid panels are devoid of vent openings, the corner posts do not include a diagonally extending panel, and the corner post pad is omitted.
Figure 17:
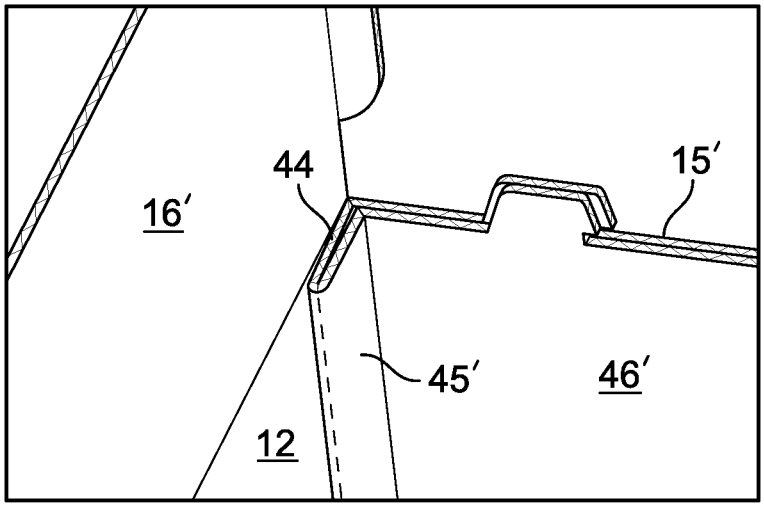
FIG. 17 is an enlarged fragmentary top isometric view of one corner of the container of the invention, showing the detail of the corner post in accordance to the $3^{rd}$ embodiment of the invention.

A third embodiment of container 60 is shown in FIGS. 16 and 17. This form of the invention differs from the previous forms primarily in that the reinforcing corner post does not extend diagonally but instead panel 45' lies against the adjacent side wall, and the corner post pads 47 are omitted. However, the third panel 46' extends over nearly half the width of the associated end wall. Further, there are no vent openings in the end walls 14', 15' or lid panels 16', 17'.

While particular embodiments of the invention have been illustrated and described in detail herein, it should be understood that various changes and modifications may be made in the invention without departing from the spirit and intent of the invention as defined by the appended claims.

What is claimed is:

1. A one-piece container formed from a single unitary blank of corrugated paperboard, wherein the container comprises:

a bottom wall, opposed side walls and opposed end walls, one of either the side walls or the end walls being inwardly inclined;

stacking tabs on a top edge of the inwardly inclined walls, said stacking tabs extending coplanar with the associated inclined wall;

tab locks in the bottom wall in positions to receive the stacking tabs of a subjacent container when said containers are stacked on top of one another; and a reinforcing corner post extending the full height of the container in each corner, said corner posts each being formed by panels extending from opposite ends of a said inwardly inclined wall, said panels including a first panel foldably joined to an end of a said inwardly inclined wall and extending perpendicular to said inclined wall, a second panel foldably joined to said first panel and extending diagonally from said first panel toward said inclined wall, and a third panel foldably joined to said second panel and extending parallel to and adhered to an adjacent one of said walls that is not inwardly inclined;

said third panels each have a stacking tab on an upper edge thereof in alignment with and lying against the stacking tab on an adjacent said inwardly inclined end wall, whereby said stacking tabs have a double thickness;

a lid panel is foldably joined to an upper edge of each said side wall;

each said lid panel has a slot in each opposite end thereof in position to receive a stacking tab on a respective said inclined end wall when the lid panel is folded into horizontal closed position over said container;

a locking tab is foldably joined to an end of each said lid panel adjacent each said slot, said locking tabs adapted to fold downwardly over an upper edge of a respective said end wall, and a heel on each said locking tab adapted to extend upwardly and lie against an outer surface of an adjacent stacking tab when said locking tab is folded downwardly over a said end wall; and a corner post pad is foldably joined to a top edge of each said first panel, said corner post pads being folded down to lie over top of an upper end of said corner post.

2. A container as claimed in claim 1, wherein:

said end walls are the inwardly inclined walls and said first panels are adhered to adjacent said side walls.

* * * * *